US006773234B2

(12) United States Patent
Sinha et al.

(10) Patent No.: US 6,773,234 B2
(45) Date of Patent: Aug. 10, 2004

(54) METHODS AND APPARATUS FOR FACILITATING PREVENTING FAILURE OF GAS TURBINE ENGINE BLADES

(75) Inventors: Sunil Kumar Sinha, Cincinnati, OH (US); Max Farson, West Chester, OH (US); Ming Cheng Li, Cincinnati, OH (US); Paul Izon, Morrow, OH (US); Nicholas Joseph Kray, Blue Ash, OH (US)

(73) Assignee: General Electric Company, Schenectady, NY (US)

( * ) Notice: Subject to any disclaimer, the term of this patent is extended or adjusted under 35 U.S.C. 154(b) by 29 days.

(21) Appl. No.: 10/273,969

(22) Filed: Oct. 18, 2002

(65) Prior Publication Data

US 2004/0076523 A1 Apr. 22, 2004

(51) Int. Cl.[7] ..... F01D 5/32
(52) U.S. Cl. ..... 416/219 R; 29/889.21
(58) Field of Search ..... 416/219 R, 215–218, 416/193 A, 248, 244 A, 500; 29/889.21, 889.2, 889.12

(56) References Cited

U.S. PATENT DOCUMENTS

| | | | | | |
|---|---|---|---|---|---|
| 1,793,468 | A | * | 2/1931 | Densmore | |
| 3,045,968 | A | | 7/1962 | Willis | |
| 4,191,509 | A | | 3/1980 | Leonardi | |
| 4,451,205 | A | * | 5/1984 | Honda et al. | 416/219 R |
| 4,645,425 | A | * | 2/1987 | Morrison, Jr. | 415/215 |
| 4,692,976 | A | | 9/1987 | Andrews | |
| 4,824,328 | A | | 4/1989 | Pisz et al. | |
| 5,087,174 | A | * | 2/1992 | Shannon et al. | 416/220 R |
| 5,110,262 | A | * | 5/1992 | Evans | 416/219 R |
| 5,183,389 | A | | 2/1993 | Gilchrist et al. | |
| 5,310,317 | A | | 5/1994 | Bailey et al. | |
| 5,425,622 | A | * | 6/1995 | Murray | 416/217 |
| 5,431,542 | A | * | 7/1995 | Weisse et al. | 416/219 R |
| 5,494,408 | A | | 2/1996 | Seeley et al. | |
| 5,511,945 | A | | 4/1996 | Glezer et al. | |
| 5,622,475 | A | | 4/1997 | Hayner et al. | |
| 6,250,166 | B1 | * | 6/2001 | Dingwell et al. | 73/810 |

* cited by examiner

*Primary Examiner*—Edward K. Look
*Assistant Examiner*—J. M. McAleenan
(74) *Attorney, Agent, or Firm*—William Scott Andes; Armstrong Teasdale LLP; Robert B. Reeser, III

(57) ABSTRACT

A method enables a rotor assembly for a gas turbine engine to be fabricated. The method includes forming a blade including an airfoil extending from an integral dovetail used to mount the blade within the rotor assembly, and extending a projection from at least a portion of the blade, such that the stresses induced within at least a portion of the blade are facilitated to be maintained below a predetermined failure threshold for the blade to facilitate preventing failure of the blade.

20 Claims, 3 Drawing Sheets

METHODS AND APPARATUS FOR FACILITATING PREVENTING FAILURE OF GAS TURBINE ENGINE BLADES

BACKGROUND OF THE INVENTION

This invention relates generally to gas turbine engine blades, and more specifically to methods and apparatus for facilitating preventing failure of gas turbine engine blades.

At least some known gas turbine engines include a core engine having, in serial flow arrangement, a fan assembly and a high pressure compressor which compress airflow entering the engine. A combustor ignites a fuel-air mixture which is then channeled through a turbine nozzle assembly towards low and high pressure turbines which each include a plurality of rotor blades that extract rotational energy from airflow exiting the combustor.

Failure of a component within a system may significantly damage the system and/or other components within the system, and may also require system operation be suspended while the failed component is replaced or repaired. More particularly, when the component is a turbofan gas turbine engine fan blade, a blade-out may cause damage to a blade that is downstream from the released blade. More specifically, depending upon the severity of the damage to the downstream blade, other blades downstream from the released blade or the damaged trailing blade may also be damaged. Damage to the trailing blade may cause the trailing blade to fail, thereby possibly requiring operation of the turbofan gas turbine engine be suspended, and/or damage to other fan blades and/or other components within the turbofan gas turbine engine.

For example, at least some known turbofan gas turbine engines include a fan base having a plurality of fan blades extending radially outwardly therefrom. The impact of a released blade upon a trailing blade may cause the trailing blade to rock about an axis tangential to rotation of the fan. The trailing blade initially rocks about the tangential axis toward a forward-section of the trailing blade such that the trailing blade may be dislodged radially outwardly away from its disk slot. The motion of the trailing blade about the tangential axis then reverses due to rotation of the fan, causing the trailing blade to rock backwards toward an aft end of the trailing blade. The rocking of the blade may induce compressive and tensile stresses in the blade. The magnitude of these tensile and compressive stresses in the trailing blade may exceed the failure threshold of the blade material causing the trailing blade to fail.

BRIEF DESCRIPTION OF THE INVENTION

In one aspect, a method is provided for fabricating a fan assembly for a gas turbine engine. The method includes forming a blade including an airfoil extending from an integral dovetail used to mount the blade within the rotor assembly, and extending a projection from at least a portion of the blade, such that the stresses induced within at least a portion of the blade are facilitated to be maintained below a predetermined failure threshold for the blade to facilitate preventing failure of the blade.

In another aspect, a gas turbine engine blade is provided that includes an airfoil, a dovetail formed integrally with said airfoil, and a projection that extends outwardly from at least one of the airfoil and the dovetail. The projection is configured to facilitate at least partially restricting movement of the blade to facilitate preventing failure of the blade.

In yet another aspect, a fan assembly for a gas turbine engine is provided. The fan assembly includes a fan hub, and at least one fan blade that extends radially outwardly from the fan hub. The fan blade includes a dovetail, an airfoil extending outwardly from the dovetail, and a projection that extends outwardly from the dovetail for maintaining stress induced within at least one of the dovetail and the airfoil below a predetermined failure threshold for the fan blade.

DETAILED DESCRIPTION OF THE INVENTION

As used herein, the terms "failure" and "fail" may include any damage or other condition that at least partially impairs a component from functioning properly, such as, for example, any damage or other condition that at least partially impairs a component from functioning properly may include, but is not limited to, complete breakage of the component, partial breakage of the component, a change in the shape of the component, and a change in the properties of the component. The above examples are intended as exemplary only, and thus are not intended to limit in any way the definition and/or meaning of the terms "failure" and "fail". In addition, although the invention is described herein in association with a turbofan gas turbine engine, and more specifically for use with a fan blade within a turbofan gas turbine engine, it should be understood that the present invention may be applicable to any component. Accordingly, practice of the present invention is not limited to fan blades or other components of turbofan gas turbine engines.

Figure 1:
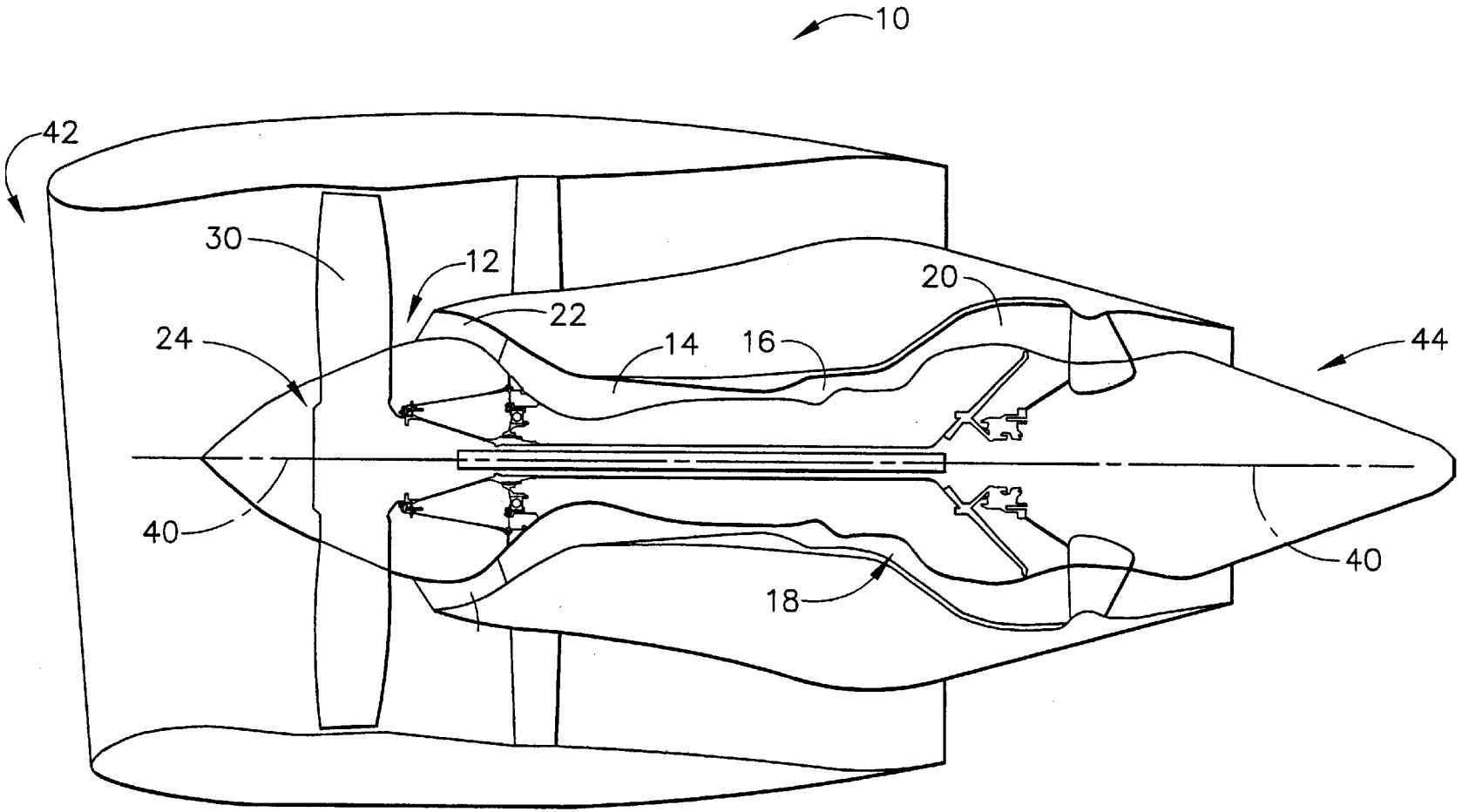
FIG. 1 is a schematic illustration of an exemplary turbofan gas turbine engine.

FIG. 1 is a schematic illustration of a turbofan gas turbine engine 10 including a fan assembly 12, a high pressure compressor 14, and a combustor 16. Engine 10 also includes a high pressure turbine 18, a low pressure turbine 20, and a booster 22. Fan assembly 12 includes a fan hub 24 having a plurality of disk slots (not shown in FIG. 1) therein and spaced circumferentially about fan hub 24. Fan assembly 12 also includes an array of fan blades 30 that extend radially outward from the disk slots and fan hub 24 to a fan blade airfoil tip 32. Fan assembly 12 rotates about an axis of rotation 40. Engine 10 has an intake side 42 and an exhaust side 44. In one embodiment, engine 10 is a GE-90 engine commercially available from General Electric Aircraft Engines, Cincinnati, Ohio.

In operation, air flows through fan assembly 12 and compressed air is supplied to high pressure compressor 14. The highly compressed air is delivered to combustor 16 where it is mixed with fuel and ignited. The combustion gases are channeled from combustor 16 and used to drive turbines 18 and 20, and turbine 20 drives fan assembly 12.

Figure 2:
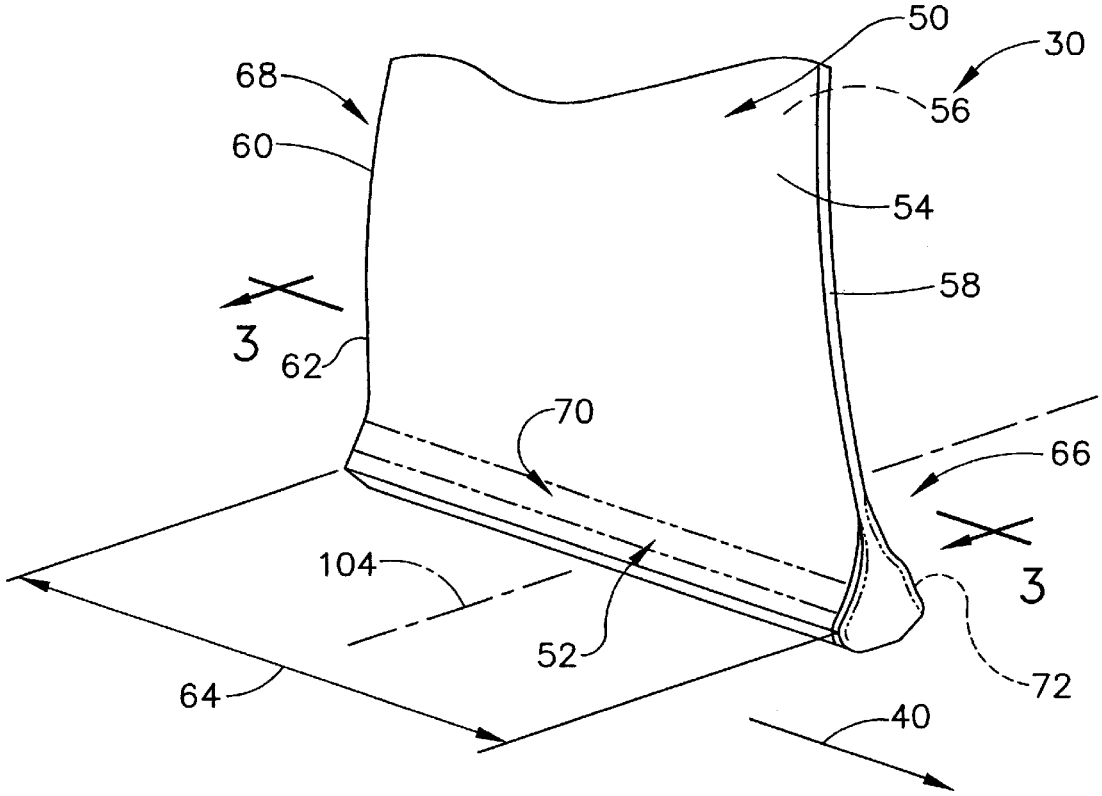
FIG. 2 is a perspective view of a portion an exemplary fan blade that may be included in the turbofan gas turbine engine shown in FIG. 1.

FIG. 2 is a perspective view of a portion an exemplary fan blade 30 that may be used with fan assembly 12 (shown in FIG. 1). Each blade 30 includes a hollow airfoil 50 and an integral dovetail 52 that is used for mounting airfoil 50 to fan hub 24 in a known manner. Each airfoil 50 includes a first contoured sidewall 54 and a second contoured sidewall 56. First sidewall 54 is convex and defines a suction side of airfoil 50, and second sidewall 56 is concave and defines a pressure side of airfoil 50. Sidewalls 54 and 56 are joined at a leading edge 58 and at an axially-spaced trailing edge 60 of airfoil 50. More specifically, airfoil trailing edge 60 is spaced chordwise and downstream from airfoil leading edge 58. First and second sidewalls 54 and 56, respectively, extend longitudinally or radially outward in span from a blade root 62 positioned adjacent dovetail 52, to airfoil tip 32 (shown in FIG. 1). Fan blade 30 extends a length 64 from a forward end 66 to an aft end 68. Dovetail 52 includes a first pressure face contact surface 70 and a second pressure face contact surface 72.

Figure 3:
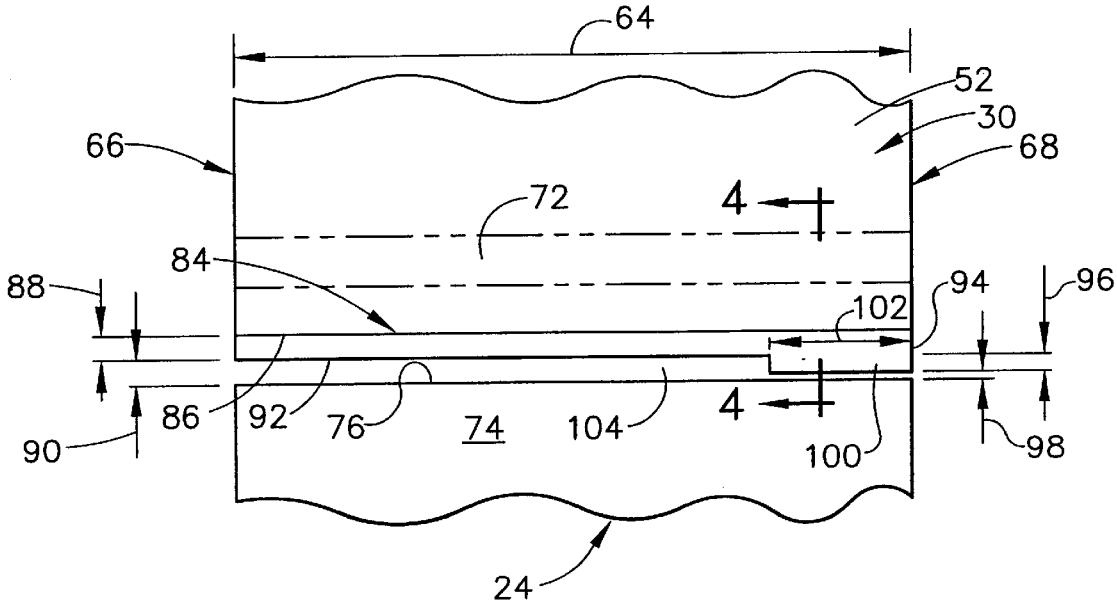
FIG. 3 is a cross-sectional view of a portion of the fan assembly shown in FIG. 1 and taken along line 3—3 of FIG. 2.
Figure 4:
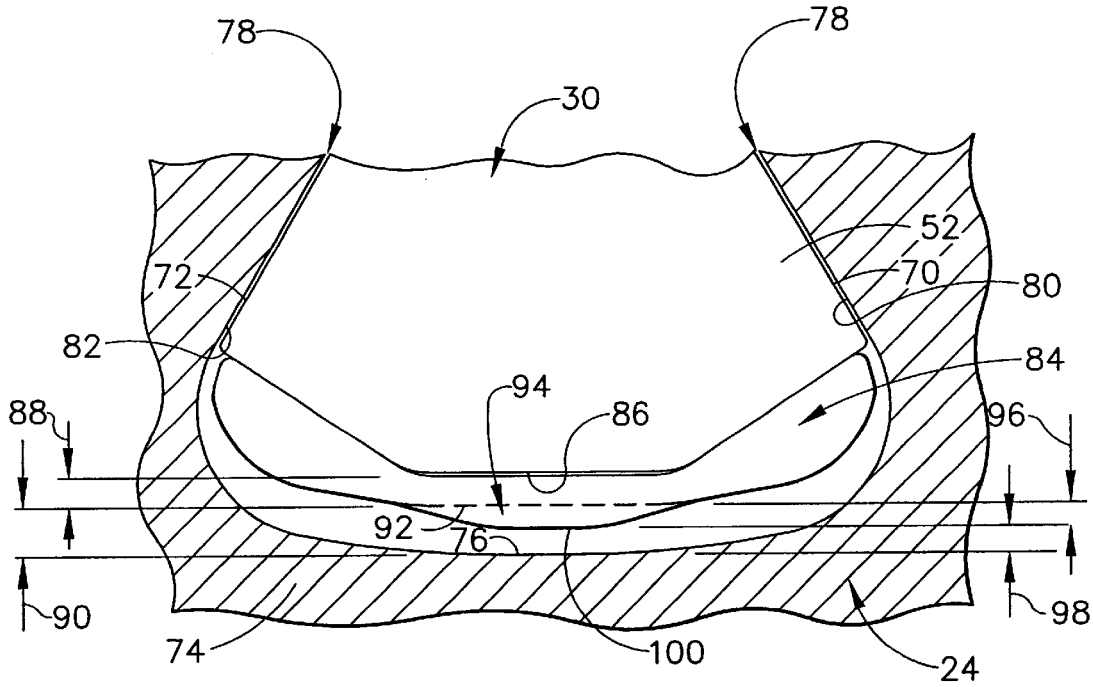
FIG. 4 is a cross-sectional view of a portion of the fan assembly shown in FIG. 3 and taken along line 4—4 of FIG. 3.

FIG. 3 is a cross-sectional view of a portion of fan assembly 12 taken along line 3—3 of FIG. 2. FIG. 4 is a cross-sectional view of a portion of fan assembly 12 taken along line 4—4 of FIG. 3. Specifically, within FIGS. 3 and 4, fan blade 30 is coupled within fan hub 24. More specifically, fan blade 30 is received and secured, also referred to herein as seated, within a disk slot 74 defined in fan hub 24. In one embodiment, fan hub 24 includes a plurality of disk slots 74 defined therein and spaced circumferentially about fan hub 24.

Each disk slot 74 extends at least length 64 such that each dovetail 52 is completely received therein. When each fan blade dovetail 52 is seated within a respective disk slot 74, each fan blade 30 extends radially outward from fan hub 24. Disk slot 74 includes a radially inner surface 76, and a portion 78 of disk slot 74 is shaped complimentary to a portion of dovetail 52, such that when dovetail 52 is seated within disk slot 74, first pressure face contact surface 70 is adjacent a first disk slot pressure surface 80, and second pressure face contact surface 72 contacts a second disk slot pressure surface 82.

In the exemplary embodiment, dovetail 52 includes a blade spacer 84 that extends outwardly from a radially inner surface 86 of dovetail 52. Alternatively, dovetail 52 does not include spacer 84. More specifically, spacer 84 extends radially inwardly towards fan hub 24 and disk slot radially inner surface 76. When fan blade 30 is seated within disk slot 74, blade spacer 84 extends a distance 88 from dovetail radially inner surface 86 such that a nominal blade/disk radial gap 90 is defined between a radially inner surface 92 of spacer 84 and disk slot radially inner surface 76. In the exemplary embodiment, blade spacer 84 extends substantially across fan blade length 64. Alternatively, in another embodiment blade spacer 84 extends across only a portion of fan blade length 64. In the exemplary embodiment, blade spacer 84 is a separate component coupled dovetail 52. In an alternative embodiment, blade spacer 84 is formed integrally with fan blade dovetail 52.

Fan blade dovetail 52 also includes a projection 94 that extends outwardly from blade spacer 84. More specifically, projection 94 extends from dovetail 52 and radially inwardly towards axis 40, fan hub 24, and disk slot radially inner surface 76. When fan blade 30 is seated within disk slot 74, projection 94 is positioned a distance 96 from blade spacer radially inner surface 92 such that a projection/disk slot radial gap 98 is defined between disk slot radially inner surface 76 and a radially inner surface 100 of projection 94. In one embodiment, gap 90 is approximately equal 0.190 inches, and gap 98 is approximately equal 0.040 inches.

In the exemplary embodiment, projection 94 is a separate component coupled to, or frictionally coupled with, blade spacer 84. In an alternative embodiment, projection 94 is formed integrally with blade spacer 84. In one embodiment, fan blade 30 does not include blade spacer 84, and rather projection 94 extends outwardly from dovetail radially inner surface 86 towards axis 40, fan hub 24, and disk slot radially inner surface 76. In an alternative embodiment, fan blade 30 does not include blade spacer 84, and projection 94 is either integrally formed with dovetail 52, or is coupled to dovetail 52. Projection 94 extends a distance 102 from fan blade aft end 68 toward fan blade forward end 66. Although projection 94 is herein illustrated as extending distance 102 from aft end 68 toward forward end 66, it should be understood that projection 94 may be positioned anywhere along blade spacer radially inner surface 92 to facilitate preventing failure of fan blade 30, as described below. For example, in an alternative embodiment, projection 94 is positioned adjacent fan blade forward end 66.

Fan assembly 12 includes an axis 104 that is tangential to disk slot radially inner surface 76. Although axis 104 is herein illustrated as extending through a general center of fan blade length 64, it should be understood that axis 104 may extend through any portion of blade 30 along length 64, and tangentially to disk slot radially inner surface 76.

During rotation of fan assembly 12, when a blade mounted to fan hub 24 upstream from blade 30 fails, or is ejected from its respective disk slot, a condition herein referred to as "blade-out", a portion of such a fan blade may impact fan blade 30. Such contact may cause fan blade 30 to rock, or rotate about axis 104. Specifically, initially, fan blade 30 rotates about axis 104 towards fan blade forward end 66 such that forward end 66 is forced radially inwardly towards disk slot radially inner surface 76, and such that fan blade aft end 68 is forced radially outwardly away from disk slot radially inner surface 76. More specifically, such impact may cause fan blade forward end 66 to partially unseat from disk slot 74. As the stress wave, initiated by the release blade impact, is reflected and propagates through blade 30, the rotational motion about axis 104 is reversed, thus causing fan blade 30 to rotate towards fan blade aft end 68 such that fan blade forward end 66 is forced radially outwardly away from disk slot radially inner surface 76, and such that fan blade aft end 68 is forced radially inwardly toward disk slot radially inner surface 76. More specifically, fan blade aft end 68 may partially unseat from disk slot 74.

When fan blade aft end 68 is at least partially unseated from disk slot 74, pressure between fan blade first pressure face contact surface 70 and first disk slot pressure surface 80, and fan blade second pressure face contact surface 72 and second disk slot pressure surface 82, is concentrated at fan blade forward end 66. More specifically, a relatively high amount of compressive stress may be concentrated in fan blade aft end 68 and a relatively high amount of tensile stress may be concentrated in fan blade forward end 66. The magnitude of these tensile and compressive stresses in fan blade 30 may exceed a predetermined failure threshold for at least a portion of fan blade 30, thus causing fan blade 30 to partially or completely fail. However, projection 94 restricts movement of fan blade 30, and more specifically restricts rotation of fan blade 30 about axis 104, thus facilitating reducing tensile stresses that may be induced within fan blade forward end 66. More specifically, as fan blade aft end 68 is unseated from disk slot 74, projection 94 partially restricts inward radial displacement of fan blade aft end 68 such that only a limited amount of tensile stress may become concentrated in fan blade forward end 66. Accordingly, projection 94 facilitates maintaining stress levels within fan blade 30 below a failure threshold of fan blade 30.

The above-described tool is cost-effective and highly reliable for facilitating preventing failure of a component. The tool facilitates maintaining stresses induced within at least a portion of a component below a predetermined failure threshold of the component. More specifically, the tool at least partially restricts movement of a component to maintain tensile and compressive stresses within the component below a failure threshold of the component. As a result, the tool facilitates preventing failure of a component in a cost-effective and reliable manner.

Exemplary embodiments of blades and assemblies are described above in detail. The systems are not limited to the specific embodiments described herein, but rather, components of each assembly may be utilized independently and separately from other components described herein. Each blade and assembly component can also be used in combination with other tool and assembly components.

While the invention has been described in terms of various specific embodiments, those skilled in the art will recognize that the invention can be practiced with modification within the spirit and scope of the claims.

What is claimed is:

1. A method for fabricating a rotor assembly for a gas turbine engine, said method comprising:

forming a blade including an airfoil extending from an integral dovetail used to mount the blade within the rotor assembly, wherein the dovetail includes a substantially planar radially inner surface that extends generally axially between an upstream and a downstream side of the dovetail, and extends generally between a suction and a pressure side of the dovetail; and extending a projection from at least a portion of the blade dovetail radially inner surface, such that the projection extends outwardly from the radially inner surface and extends extending over a less than 50% the distance between the dovetail upstream and downstream sides, and only partially between the dovetail suction and pressure sides, such that the stresses induced within at least a portion of the blade are facilitated to be maintained below a predetermined failure threshold for the blade to facilitate preventing failure of the blade.

2. A method in accordance with claim 1 wherein extending a projection from at least a portion of the blade comprises coupling a projection to at least a portion of the blade such that the projection extends outwardly from at least a portion of the blade.

3. A method in accordance with claim 1 wherein extending a projection from at least a portion of the blade comprises integrally forming a projection on at least a portion of the blade such that the projection extends outwardly from at least a portion of the blade.

4. A method in accordance with claim 1 wherein extending a projection from at least a portion of the blade comprises using the projection to facilitate at least partially restricting movement of at least a portion of the blade.

5. A method in accordance with claim 1 wherein extending a projection from at least a portion of the blade comprises using the projection to facilitate maintaining tensile stresses within at least a portion of the blade below a predetermined failure threshold for the blade.

6. A method in accordance with claim 1 wherein extending a projection from at least a portion of the blade comprises using the projection to facilitate at least partially restricting rotation of at least a portion of the blade.

7. A method in accordance with claim 1 wherein extending a projection from at least a portion of the blade comprises using the projection to facilitate maintaining stresses within at least a portion of the blade below a predetermined failure threshold for the blade during at least one of failure of a second gas turbine engine blade and blade-out of a second gas turbine engine blade.

8. A method in accordance with claim 7 using the projection to maintain stress within at least a portion of the blade comprises using the projection to facilitate at least partially restricting movement of at least a portion of the blade during at least one of failure of a second gas turbine engine blade and blade-out of a second gas turbine engine blade.

9. A gas turbine engine blade comprising:

an airfoil;

a dovetail formed integrally with said airfoil, said dovetail comprising a substantially planar radially inner surface having a width extending between an upstream and a downstream side of the dovetail, and a length extending between a pressure and a suction side of the dovetail; and a projection extending outwardly from said dovetail radially inner surface, said projection configured to facilitate at least partially restricting movement of said blade to facilitate preventing failure of said blade, said projection having a width that is less than 50% the distance said dovetail length.

10. A blade in accordance with claim 9 wherein said projection further configured to facilitate maintaining stresses induced within at least one of said airfoil and said dovetail below a predetermined failure threshold for said blade.

11. A blade in accordance with claim 10 wherein said projection further configured to facilitate maintaining tensile stress within at least one of said dovetail and said airfoil below a predetermined failure threshold for said blade.

12. A blade in accordance with claim 9 wherein said projection extends radially outwardly from said dovetail.

13. A fan assembly for a gas turbine engine, said fan assembly comprising:

a fan hub; and at least one fan blade extending radially outwardly from said fan hub, said fan blade comprising a dovetail, an airfoil extending outwardly from said dovetail, said dovetail comprising a substantially planar radially inner surface having a width extending between an upstream and a downstream side of the dovetail, and a length extending between a pressure and a suction side of the dovetail; and a projection extending outwardly from said dovetail radially inner surface for maintaining stress induced within at least one of said dovetail and said airfoil below a predetermined failure threshold for said fan blade, said projection having a width that is less than said dovetail width and a length that is less than less than 50% the distance of said dovetail length.

14. A fan assembly in accordance with claim 13 wherein said projection configured to facilitate at least partially restricting movement of said fan blade such that stresses induced within at least one of said fan blade airfoil and said fan blade dovetail are facilitated to be maintained below a predetermined failure threshold for said fan blade.

15. A fan assembly in accordance with claim 13 wherein said projection coupled to said dovetail.

16. A fan assembly in accordance with claim 13 wherein said projection formed integrally with said dovetail.

17. A fan assembly in accordance with claim 13 wherein said dovetail comprises a spacer extending outwardly from said dovetail, said projection extending outwardly from said spacer.

18. A fan assembly in accordance with claim 13 wherein said fan blade further comprises an airfoil tip, said airfoil extending between said dovetail and said airfoil tip, said projection extending outwardly from said dovetail portion in a direction away from said airfoil tip.

19. A fan assembly in accordance with claim 13 wherein said fan hub comprises at least one disk slot therein, said dovetail at least partially received within said disk slot such that said fan blade secured with respect to said fan base, said projection extends from said dovetail radially into said disk slot to facilitate at least partially restricting movement of said fan blade within said disk slot.

20. A fan assembly in accordance with claim 19 wherein said projection further configured to facilitate at least partially restricting rotation of said fan blade with respect to said disk slot.

* * * * *

UNITED STATES PATENT AND TRADEMARK OFFICE

CERTIFICATE OF CORRECTION

PATENT NO. : 6,773,234 B2
DATED : August 10, 2004
INVENTOR(S) : Sinha et al.

It is certified that error appears in the above-identified patent and that said Letters Patent is hereby corrected as shown below:

Column 5,
Line 33, delete “blade”.

Column 6,
Line 53, between “than” and “50%” delete “less than”.

Signed and Sealed this

Sixth Day of September, 2005

JON W. DUDAS
*Director of the United States Patent and Trademark Office*